United States Patent [19]

Faust

[11] Patent Number: 4,877,251

[45] Date of Patent: Oct. 31, 1989

[54] PUTTING DEVICE

[76] Inventor: Wayne Faust, 2941 Kinwood Dr., Antioch, Tenn. 37013

[21] Appl. No.: 234,081

[22] Filed: Aug. 19, 1988

[51] Int. Cl.[4] ..... A63B 69/36

[52] U.S. Cl. ..... 273/194 A; 273/177 R; 273/162 E; 272/8 N

[58] Field of Search ..... 273/186 E, 186 A, 162 E, 273/194 A, 177 R; 272/8 N

[56] References Cited

U.S. PATENT DOCUMENTS

| | | | |
|---|---|---|---|
| 2,094,766 | 10/1937 | Costello | 273/186 E |
| 3,730,529 | 5/1973 | Donofrio | 273/186 A |
| 3,749,407 | 7/1973 | Prochnow | 273/162 E |
| 4,139,198 | 2/1979 | Kanavas | 273/186 A |

FOREIGN PATENT DOCUMENTS

| | | | |
|---|---|---|---|
| 1236982 | 6/1971 | United Kingdom | 273/186 A |

*Primary Examiner*—George J. Marlo
*Attorney, Agent, or Firm*—Larson and Taylor

[57] ABSTRACT

A novelty putting device for a golf ball or facsimile thereof comprises the integral combination of a putter including a shaft and a putter head; a funnel-like guide tube having a tapered portion and including a guide track formed in the inner bottom surface thereof for guiding the movement of the ball after the ball is struck by the putter; and an L-shaped bracket connecting the guide tube to the putter and supporting the putter head in spaced relationship to the guide tube.

12 Claims, 1 Drawing Sheet

PUTTING DEVICE

FIELD OF THE INVENTION

The present invention relates to a novelty putting device for use as a joke gift or for general enjoyment.

BACKGROUND OF THE INVENTION

Anyone familiar with the game of golf is aware of the difficulties associated with putting. Stories are often told on, and jokes played on, golfers which concern their inability to putt in general or their missing of a particularly important putt or putts. Novelty devices reflecting this theme, and which are given as a "gag gift" or employed as part of a joke, include simulated putting greens with grossly oversized cups and putters with oversized putting heads.

Patents in this general field which may be of background interest include: U.S. Pat. Nos. 3,558,140 (Romeo); 3,572,720 (Berg); 3,972,532 (Bradley); and 4,120,502 (Martin).

SUMMARY OF THE INVENTION

In accordance with the invention, a novelty putter device is provided which can, for example, be presented as a joke gift to "assist" a golfer with his or her putting or used as a novelty putting practice device or used simply as a toy for enjoyment.

According to a preferred embodiment thereof, the novelty golf putter device of the invention comprises: a putter including a shaft and putter head; guide means for guiding the path of travel of a golf ball or a facsimile thereof after the ball is struck by the putter head; and connecting means for connecting the guide means to the putter and for supporting the guide means in fixed, spaced relationship to the putter head.

The guide means preferably comprises an elongate tunnel member through which the golf ball travels including an opening at the proximal end thereof relative to the putter head in which the ball is initially received after being struck and an opening at the distal end thereof through which the ball exits. Advantageously, the tunnel member is tapered down over at least a portion of the length thereof to a reduced opening at the distal end thereof. Advantageously, this reduced opening is approximately the size of the golf ball, and the tunnel member preferably includes a guide track in the bottom inner surface thereof for guiding the movement of the ball, so that when the ball exits from the exit opening in the tunnel member the ball will travel in the direction that the tunnel member points.

In an advantageous embodiment, the tunnel member includes first and second cylindrical portions joined by an intermediate tapered portion. Preferably, the connecting means comprises an L-shaped bracket. This L-shaped bracket advantageously comprises a first arm connected to the putter head and a second, longer arm connected at one end thereof to the tunnel member.

Although a conventional putter can be adapted to the present invention, in a preferred embodiment a simple putter is used wherein the putter shaft includes a screw portion at one end thereof which is screwed into said putter head.

Other features and advantages of the invention will be set forth in, or apparent from, the detailed description of a preferred embodiment of the invention which follows.

DESCRIPTION OF A PREFERRED EMBODIMENT

Figure 1:
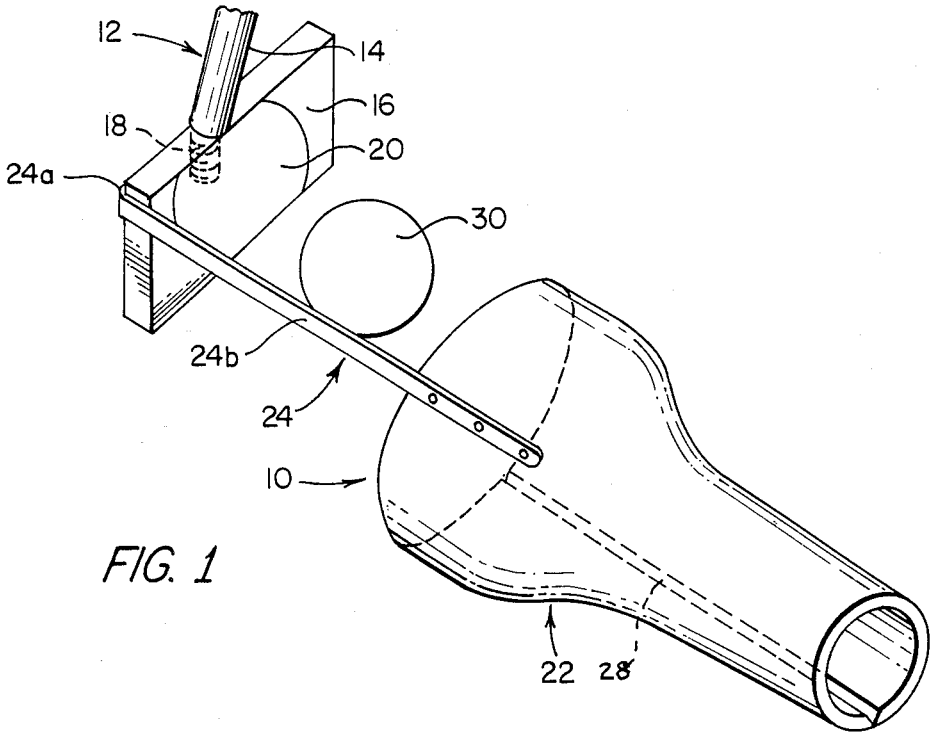
FIG. 1 is a perspective view of a novelty putter device constructed in accordance with a preferred embodiment of the invention.
Figure 2:
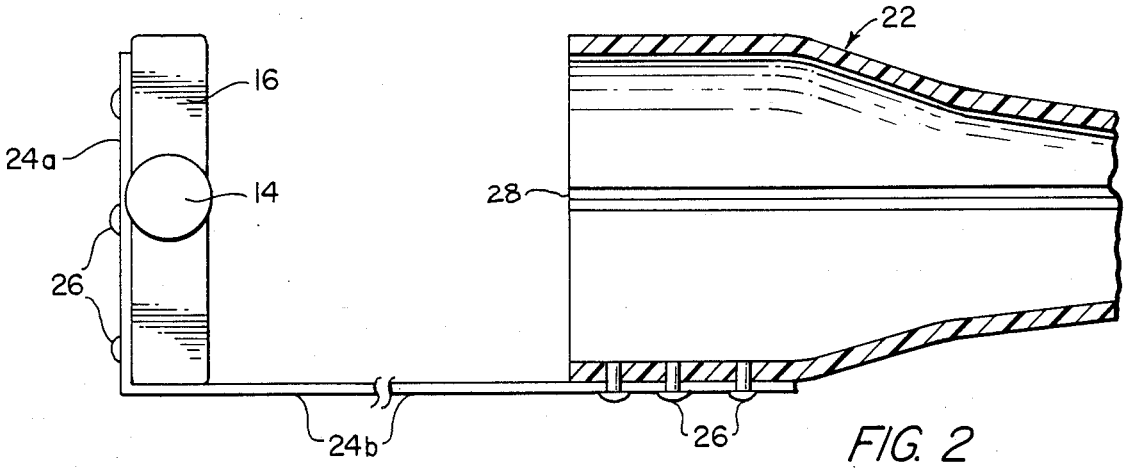
FIG. 2 is a top plan view, partially in section and drawn to an enlarged scale, of the putter of FIG. 1.
Figure 3:
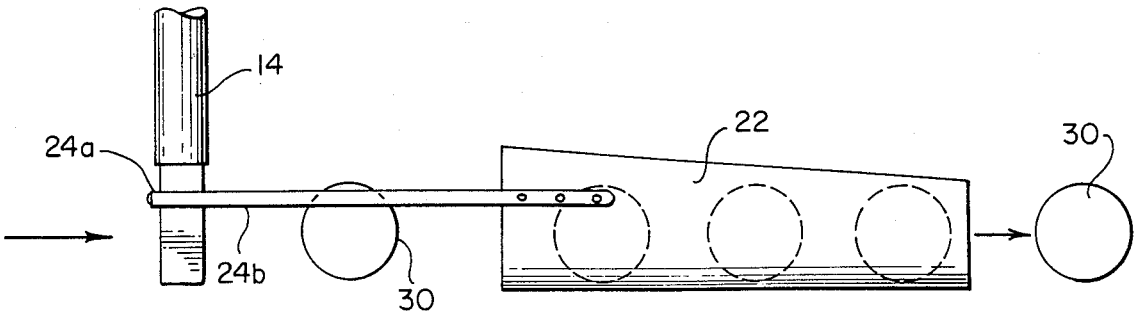
FIG. 3 is a side elevational view, drawn to a reduced scale, of the putter of FIG. 1.

Referring to FIGS. 1 to 3, a novelty putter device is shown which is constructed in accordance with a preferred embodiment of the invention. The putter device, which is generally denoted 10, includes a putter 12 comprising a shaft or handle 14 connected to a putter head or base 16. Although a conventional putter could be used and the other components described below affixed thereto, a simple putter design is preferably employed wherein the putter shaft 14 is simply affixed to the putter head 16 by a screw 18 located at the end of shaft 14 and extending outwardly therefrom so as to be screwed into putter head 16. The face of putter head 16 preferably includes an image of a golf ball, indicated at 20, on the hitting surface thereof.

An elongate "tunnel" or funnel-shaped tubular guide member 22 is attached to putter head 16 by an L-shaped bracket 24. As illustrated, one leg **24*a* of L-bracket 24 is affixed to putter head 16 while the other leg 24*b* is affixed to one side of tunnel 22. The L-shaped bracket 24 can be so affixed by any suitable means including plastic rivets 26**, as illustrated, or screws, or even over-fitting rubber bands.

In one preferred embodiment, guide tunnel 22, as best seen in FIG. 2, includes a first, relatively wide section **22*a*, an intermediate tapered section 22*b*, and a final, relatively narrow section 22*c*. A guide groove or track 28 is formed in the bottom inside surface of tunnel 22 for guiding the travel of a golf ball, denoted 30, therealong. Such a golf ball 30** is preferably included as part of the overall kit or assembly, and when included is preferably made of plastic.

Although the invention is clearly not limited to these dimensions, in an exemplary embodiment, the putter handle 14 is 24" long and ¾" in diameter, with screw 18 being ½" in diameter and 1" deep; the putter head 16 is 1" wide by 2" high by 4" long; the arms of the L-shaped brace 24 are 4" and 8" long, respectively, with the spacing between the club head 16 and tunnel 22 being about 4"; the sections of tunnel 22, beginning at the putter side, are enlarged section, 4", 8" tapered transition section and 8" narrow end section respectively, with the smaller end opening being 2" in diameter and the guide groove or track 28 being a ¼×¼" groove.

In use, the device of the invention is employed in generally the same way as a conventional putter with the plastic ball 30 being placed between putter head 16 and guide tunnel 22, or with the device 10 being placed around the ball 30 so that ball 30 is so disposed or positioned. Of course, the guide tunnel 22 moves with putter 12 and thus, by taking a short backswing or otherwise moving the putter head 22 back away from the ball 30 (a distance limited by the spacing between putter head 16 and tunnel 22), and then bringing the club head 16 forward by limited swinging of club 12, the ball 30 can be struck and readily caused to enter guide tunnel 22. The ball then travels through tunnel 22, along guide track or groove 28, and exits therefrom in the direction in which tunnel 22 is pointing, as indicated in FIG. 3.

Although the present invention has been described relative to exemplary embodiments thereof, it will be understood by those skilled in the art that variations and modifications can be effected in these exemplary embodiments without departing from the scope and spirit of the invention.

I claim:

1. A novelty golf putter device comprising:

a putter including a shaft and putter head;

guide means for guiding the path of travel of a golf ball or a facsimile thereof, after the ball is struck by the putter head; and connecting means connecting said guide means to said putter and supporting said guide means in fixed, spaced relationship to said putter head forwardly of the putter head in the direction of movement of the putter head when striking the ball, by an amount sufficient to permit the insertion of such a golf ball or facsimile thereof between the putter head and the guide means.

2. A putter device as claimed in claim 1 wherein said guide means comprises a tunnel member through which the golf ball travels including an opening at the proximal end thereof relative to said putter head in which the ball is initially received after being struck and an opening at the distal end thereof through which the ball exits.

3. A putter device as claimed in claim 2 wherein said tunnel member is tapered down over at least a portion of the length thereof to a reduced opening at the distal end thereof.

4. A putter device as claimed in claim 3 wherein said tunnel member includes a guide track in the bottom inner surface thereof for guiding the movement of the ball.

5. A putter device as claimed in claim 3 wherein said tunnel member includes first and second cylindrical portions joined by an intermediate tapered portion.

6. A putter device as claimed in claim 2 wherein said connecting means comprises an L-shaped bracket.

7. A putter device as claimed in claim 6 wherein said L-shaped bracket includes a first arm connected to said putter head and a second, longer arm connected at one end thereof to said tunnel member.

8. A putter device as claimed in claim 1 wherein said putter shaft includes a screw portion at one end thereof which is screwed into said putter head.

9. A putter device as claimed in claim 1 wherein said guide means includes a guide track therein for guiding the movement of the ball.

10. A putter device as claimed in claim 1 wherein said connecting means comprises an L-shaped bracket.

11. A putter device as claimed in claim 10 wherein said L-shaped bracket includes a first arm affixed to the putter head and a second, longer arm affixed at one end thereof to said tunnel member.

12. In combination, a novelty putter device and a golf ball or facsimile thereof, said novelty putter device comprising the integral combination of a putter including a shaft and a putter head; a guide member having a tapered portion and including a guide track formed in the inner bottom surface thereof for guiding the movement of the ball after the ball is struck by the putter, and means for connecting said guide member to said putter and for supporting said putter head in spaced relationship to said guide member forwardly of the putter head in the direction of movement of the putter head when striking the ball, by an amount sufficient to permit the insertion of such a golf ball or facsimile thereof between the putter head and the guide means.

* * * * *